US010598165B2

(12) United States Patent
Wang

(10) Patent No.: US 10,598,165 B2
(45) Date of Patent: Mar. 24, 2020

(54) ELECTRIC-DRIVEN AIR PUMP

(71) Applicant: Beto Engineering And Marketing Co., Ltd., Taichung (TW)

(72) Inventor: Lopin Wang, Taichung (TW)

(73) Assignee: BETO ENGINEERING AND MARKETING CO., LTD., Taichung (TW)

( * ) Notice: Subject to any disclaimer, the term of this patent is extended or adjusted under 35 U.S.C. 154(b) by 205 days.

(21) Appl. No.: 15/793,597

(22) Filed: Oct. 25, 2017

(65) Prior Publication Data

US 2019/0120216 A1 Apr. 25, 2019

(51) Int. Cl.

| | |
|---|---|
| ***F04B 17/03*** | (2006.01) |
| ***F04B 35/04*** | (2006.01) |
| ***F04B 39/00*** | (2006.01) |
| ***F04B 39/12*** | (2006.01) |
| *F04B 27/02* | (2006.01) |
| *F04D 25/06* | (2006.01) |

(52) U.S. Cl.

CPC ..... *F04B 17/03* (2013.01); *F04B 35/04* (2013.01); *F04B 39/0016* (2013.01); *F04B 39/125* (2013.01); *F04B 27/02* (2013.01); *F04D 25/0673* (2013.01)

(58) Field of Classification Search

CPC ..... F04B 17/03; F04B 35/04; F04B 33/005; F04B 37/10; F04B 39/125

See application file for complete search history.

(56) References Cited

U.S. PATENT DOCUMENTS

| | | | | |
|---|---|---|---|---|
| 5,518,375 A | 5/1996 | Vandromme et al. | | |
| 2004/0115073 A1* | 6/2004 | Lin | F04B 35/04 | 417/411 |
| 2015/0322935 A1 | 11/2015 | Wang | | |

FOREIGN PATENT DOCUMENTS

| | | | | |
|---|---|---|---|---|
| CN | 101063445 A | 10/2007 | | |
| GB | 2205361 A | * 12/1988 | F04B 9/047 | |
| JP | 5893972 A | 6/1983 | | |
| JP | 2004/232609 A | 8/2004 | | |
| JP | 2007/291910 A | 11/2007 | | |

OTHER PUBLICATIONS

Search Report appended to a Taiwan Office Action issued in corresponding application TW106127111 dated Feb. 27, 2018, 2 pages.

* cited by examiner

*Primary Examiner* — Kenneth J Hansen

(74) *Attorney, Agent, or Firm* — Muncy, Geissler, Olds & Lowe, P.C.

(57) ABSTRACT

An electric-driven air pump includes an outer housing unit, an electric-driven mechanism and a piston mechanism. The outer housing unit includes a connecting seat with a gas outlet section, and a cylinder with a cylinder chamber. The electric mechanism is mounted to the outer housing unit and includes a motor. The piston mechanism includes a driven piston disposed in the cylinder chamber, a threaded driving rod formed with a helical guide slot, rotated by the motor, and connected to the driven piston such that rotation of the threaded driving rod drives reciprocal movement of the driven piston in the cylinder chamber, and a guide pin fixed in the driven piston and extending into the helical guide slot to be driven along the helical guide slot.

9 Claims, 12 Drawing Sheets

ELECTRIC-DRIVEN AIR PUMP

FIELD

The disclosure relates to an air pump, and more particularly to an electric-driven air pump.

BACKGROUND

A conventional electric-driven air pump, such as the one disclosed in US Patent Application Publication No. 2004/0115073 A1, includes a head having a cylinder chamber, a body connected axially to the head, a motor installed within the head, a set of bevel gears driven by a shaft of the motor, and a piston assembly having linkage with the set of bevel gears. The set of bevel gears includes a small bevel gear connected to the shaft, a large bevel gear that is meshed with the small bevel gear, and a driving crank eccentrically connected to the large bevel gear. The driving crank, powered by the motor, drives reciprocal motion of the piston assembly to draw in and push air in and out of the cylinder chamber.

In order to ensure that there is enough transmission power in the air pump, the radius of the bevel gears cannot be too small. Likewise, the radius of the head and the body cannot be too small either in order to accommodate the bevel gears inside a chamber of the head. In addition, utilizing beveling gears for power transmission tends to produce grinding noise as well.

SUMMARY

Therefore, an object of the disclosure is to provide an electric-driven air pump that can alleviate at least one of the drawbacks associated with the abovementioned prior art.

The electric-driven air pump is adapted to inflate an inflatable object and includes an outer housing unit, an electric-driven mechanism, and a piston mechanism. The outer housing unit includes a connecting seat, which includes a gas outlet section adapted to be connected to the inflatable object, and a cylinder having a cylinder chamber. The gas outlet section includes a valve-controlled air passage that is spatially communicated with the cylinder chamber. The electric-driven mechanism is mounted to the outer housing unit and includes a motor. The piston mechanism includes a driven piston, a threaded driving rod, and a guide pin. The driven piston is disposed in the cylinder chamber. The threaded driving rod is rotated by the motor, is connected to the driven piston in such a manner that rotation of the threaded driving rod drives reciprocal movement of the driven piston in the cylinder chamber, and is formed with a helical guide slot. The guide pin is fixed in the driven piston and extends into the helical guide slot. The motor is operable to rotate the threaded driving rod to drive reciprocal motion of the driven piston in the cylinder chamber, such that the guide pin moves along the helical guide slot.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
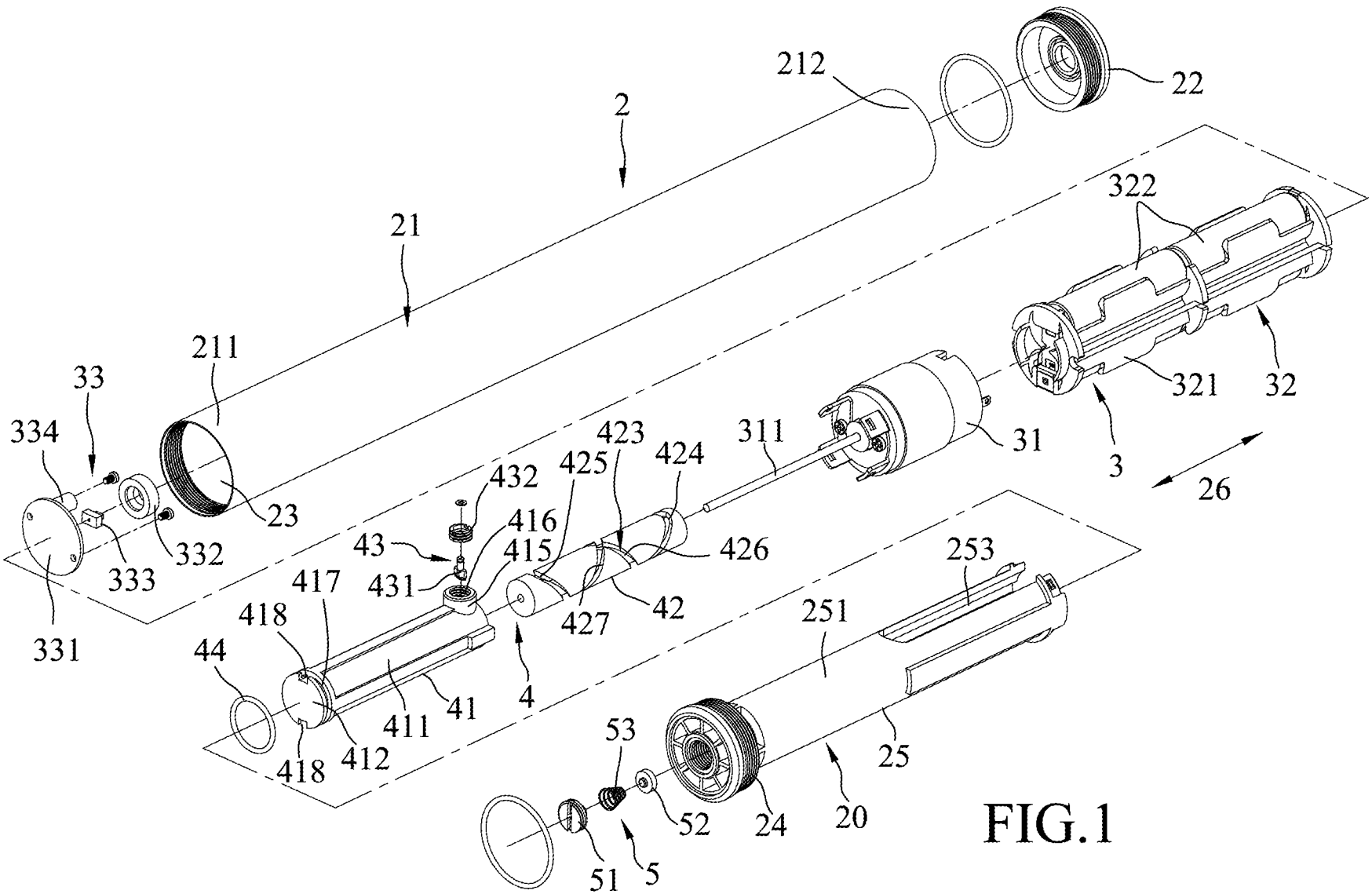
FIG. 1 is an exploded perspective view of a first embodiment of an electric-driven air pump according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
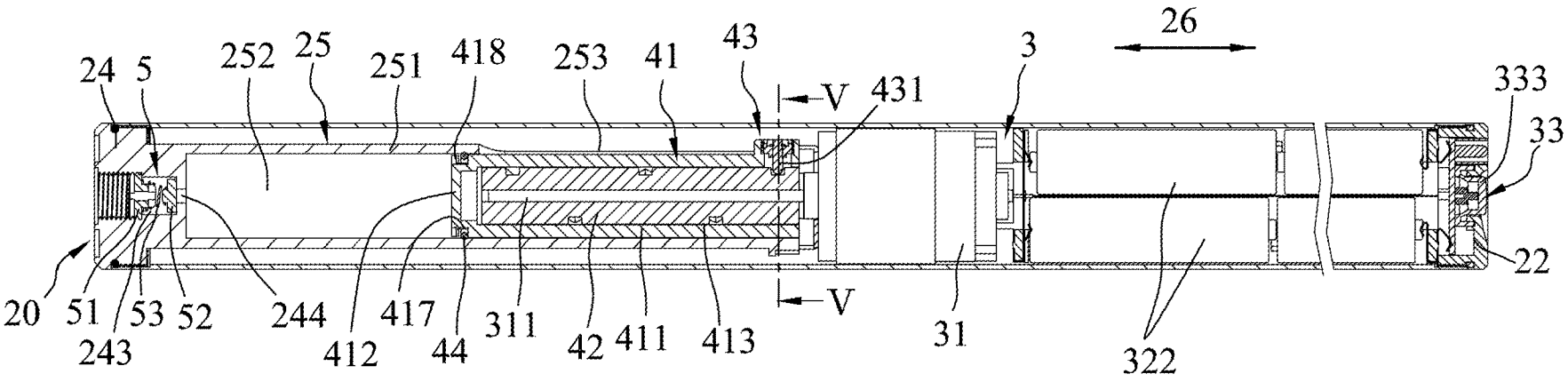
FIG. 2 is a fragmentary sectional view of the first embodiment, illustrating a driven piston of the electric-driven air pump in its default position.
Figure 3:
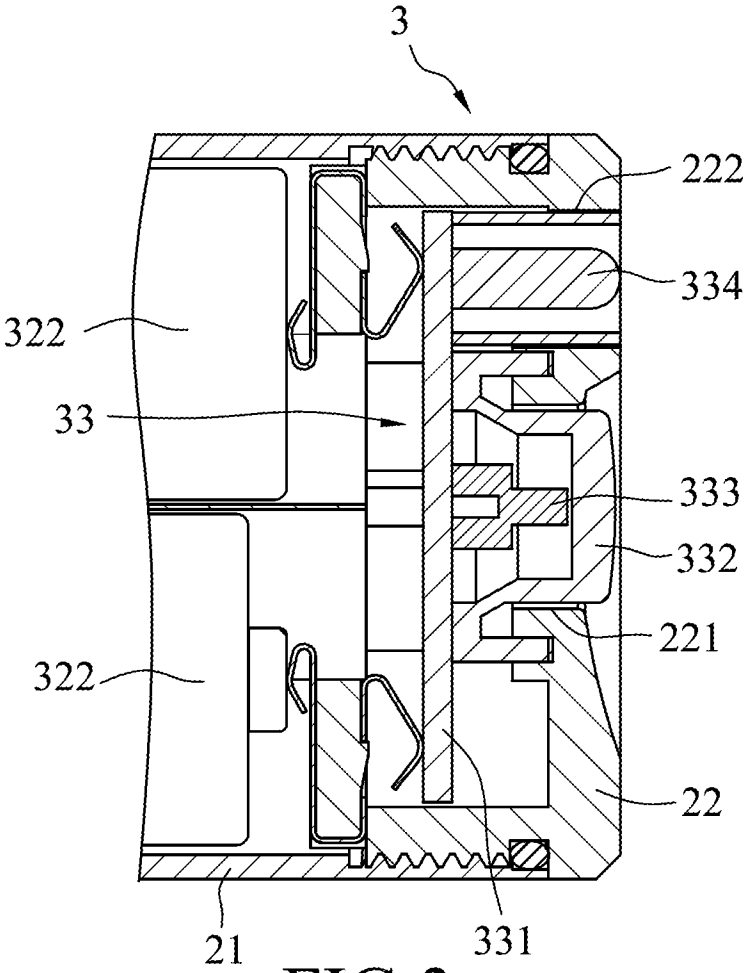
FIG. 3 is an enlarged fragmentary sectional view of an electric-driven mechanism of the first embodiment.

Referring to FIGS. 1,2 and 3, a first embodiment of an electric-driven air pump of this disclosure is adapted to inflate an inflatable object (not shown), and includes an outer housing unit 2, an electric driving mechanism 3, a piston mechanism 4, and a check valve 5.

The outer housing unit 2 includes a connecting seat 20, an extending tube member 21 and an end cover 22. The extending tube 21 includes a first tube end 211 and a second tube end 212 opposite to the first tube end 211 in a longitudinal direction 26. The connecting seat 20 is mounted to the first tube end 211, while the end cover 22 is removably and threadably engaged to the second tube end 212 opposite to the connecting seat 20. Collectively, the extending tube member 21, the end cover 22 and the connecting seat 20 define a receiving space 23 therebetween. The end cover 22 includes a first switch hole 221 and a first charge hole 222.

The connecting seat 20 is registered with and connected to the extending member 21 in the longitudinal direction 26. In this embodiment, the connecting seat 20 is threadably engaged to the extending member 21. The connecting seat 20 includes a gas outlet section 24 that is threadably engaged to the first tube end 211 of the extending member 21 and a cylinder 25 that extends from the gas outlet section 24 toward the end cover 22 in the longitudinal direction 26.

Figure 4:
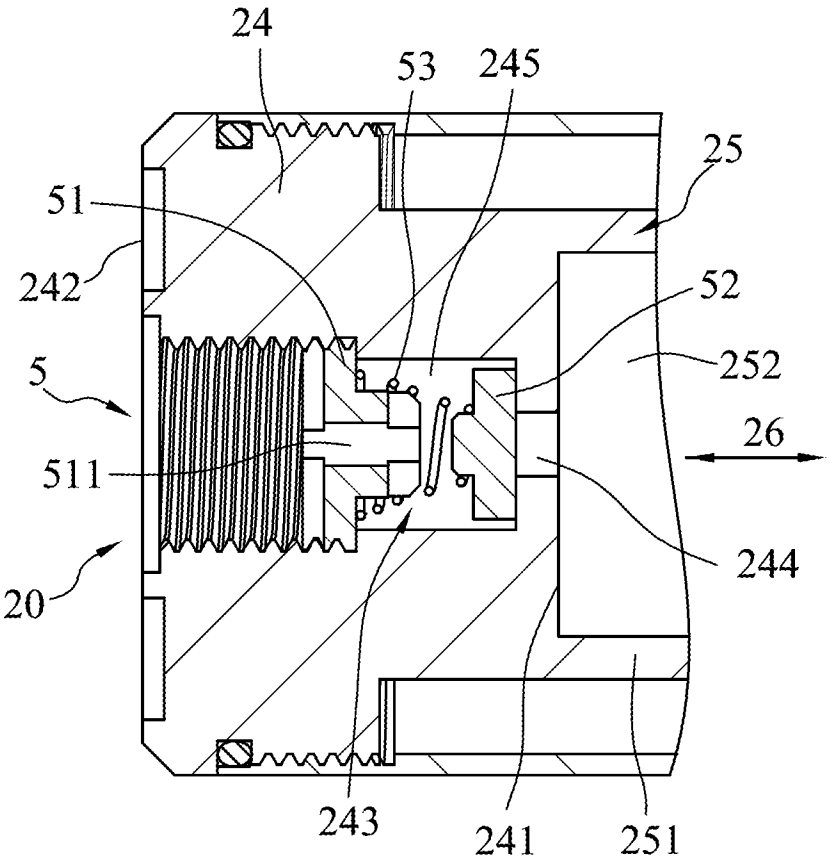
FIG. 4 is an enlarged fragmentary sectional view of a check valve of the first embodiment.

Referring to FIGS. 1 and 4, the cylinder 25 includes a cylinder wall 251, which defines a cylinder chamber 252 extending axially therein. The cylinder wall 251 includes a longitudinal slot 253 that extends in the longitudinal direction 26 and that is spatially communicated with the cylinder chamber 252. The gas outlet section 24 includes a first side 241 facing toward the cylinder chamber 252, a second side 242 that is spaced apart from the first side 241 in the longitudinal direction 26, and a valve-controlled air passage 243 that extends through the first and second sides 241, 242 to be spatially communicated with the cylinder chamber 252 and to be adapted to be connected to the inflatable object. The valve-controlled air passage 243 includes a shrunk section 244 that is proximate to the first side 241 and that is spatially communicated with the cylinder chamber 252, and an expanded section 245 that is located between the second side 242 and the shrunk section 244.

Figure 5:
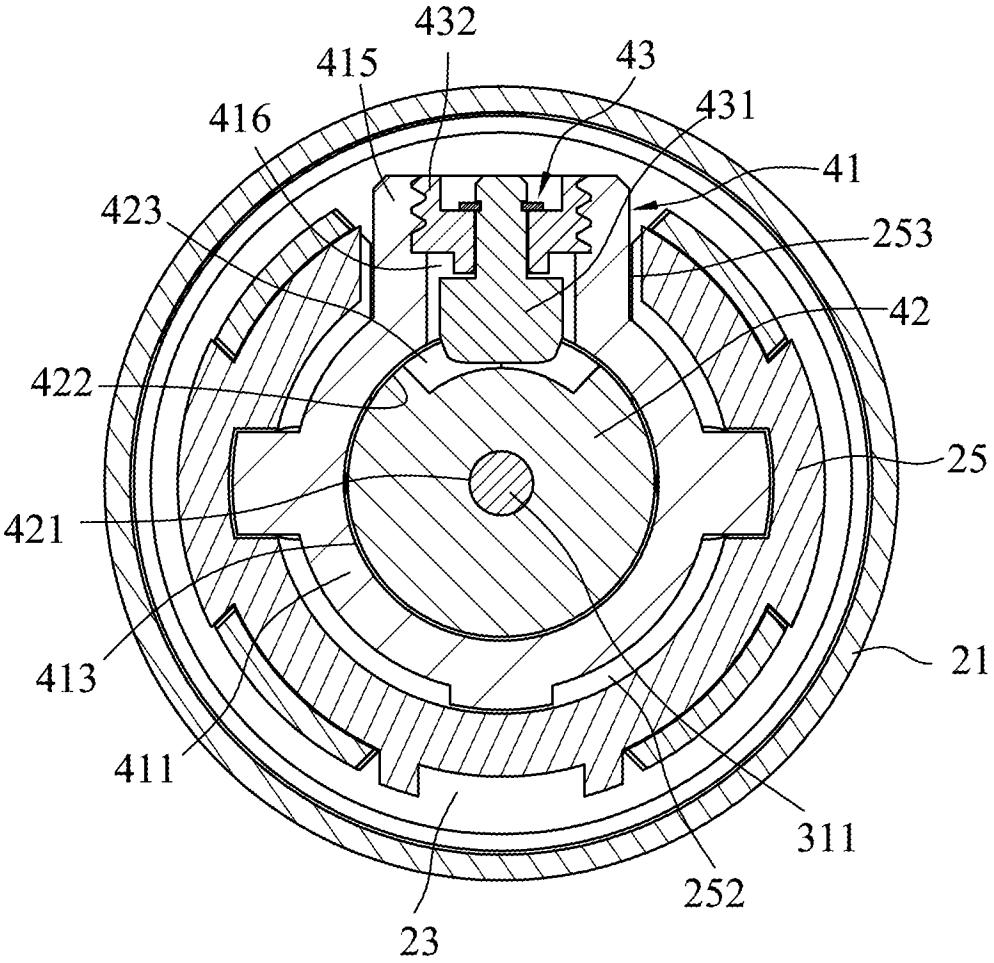
FIG. 5 is a sectional view taken along line V-V of FIG. 2.

Referring to FIGS. 1, 3 and 5, in this embodiment, the electric driving mechanism 3 is received in the receiving space 23 and includes a motor 31, a power supply module 32 that provides electric power to the motor 31, and a controlling module 33 that is proximate to the end cover 22 and is electrically connected to the power supply module 32. The motor 31 includes a shaft 311 extending in the longitudinal direction 26. The power supply module 32 includes a battery holder 321 and at least one battery 322 mounted on the battery holder 321. The controlling module 33 is operable to control operation of the motor 31 and includes a circuit board 331 that is electrically connected to the motor 31 and the at least one battery 322, a control button 332 that corresponds in position to first switch hole 221 of the end cover 22, and a control switch 333 that is electrically connected to the circuit board 331 and the control button 332. The circuit board 331 includes a charge socket 334 that corresponds in position to and extends toward the first charge hole 222. The at least one battery 322 may be recharged with external power supply through the charge socket 334. While a plurality of batteries 322 are used in this embodiment, one battery 322 is capable to accomplish the same task as well. It should also be noted that there is no restriction to which type of power supplying method is utilized.

The piston mechanism 4 is received in the receiving space 23, and includes a driven piston 41, a threaded driving rod 42, and a guiding component 43. The driven piston 41 includes a surrounding wall 411 that extends in the longitudinal direction 26, an end wall 412 that is connected to an end of the surrounding wall 411 and extends into the cylinder chamber 252, a receiving room 413 that is defined by the surrounding wall 411 and the end wall 412 and receives the threaded driving rod 42, a positioning protrusion 415 protruding from the surrounding wall 411 into the longitudinal slot 253 of the connecting seat 20, and an assembling hole 416 extending through the positioning protrusion 415 and the surrounding wall 411 in a direction perpendicular to the longitudinal direction 26. The end wall 412 includes a flange 417 and two gaps 418 that extend through the flange 417. The piston mechanism 4 further includes a leakproof ring 44 that is mounted inside a groove of the flange 417.

The threaded driving rod 42 includes a shaft hole 421 that allows the shaft 311 of the motor 31 to be inserted therethrough, a rod surface 422 surrounding the shaft hole 421, and a helical guide slot 423 formed on the rod surface 422. The helical guide slot 423 includes a starting slot section 424, an ending slot section 425 that is opposite to the starting slot section 424 in the longitudinal direction 26, a first guiding slot section 426 that extends helically from the starting slot section 424 to the ending slot section 425, and a second guiding slot section 427 that extends helically from the ending slot section 425 to the starting slot section 424. In this embodiment, each of the first and second guiding slot sections 426, 427 has at least two helical turns around the threaded driving rod 42, and the first and second guiding slot sections 426, 427 partially intersect with each other.

The guiding component 43 is utilized to transfer the rotational force of the threaded driving rod 42 into the reciprocal movement of the driven piston 41 in the cylinder chamber 252, and includes a guide pin 431 that is fixed in the assembling hole 416 of the driven piston 41 and that extends into the helical guide slot 423, and a fixing block 432 that fixes the guide pin 431 onto the assembling hole 416. In this embodiment, the fixing block 432 is threadably fixed to the positioning protrusion 415, but is not limited to such.

Referring to FIGS. 1, 4 and 5, the check valve 5 is mounted to the valve-controlled air passage 243 of the connecting seat 20, and includes a fixed valve seat 51 that is threadably mounted to the gas outlet section 24 of said connecting seat 20 in the expanded section 245 of the valve-controlled air passage 243, a movable valve seat 52 that is spaced apart from the fixed valve seat 51 and that is able to open and close the shrunk section 244 of the valve-controlled air passage 243, and a resilient member 53 that is disposed between the fixed and movable valve seats 51, 52. The fixed valve seat 51 includes an outlet passage 511 that is spatially communicated with the cylinder chamber 252.

Figure 6:
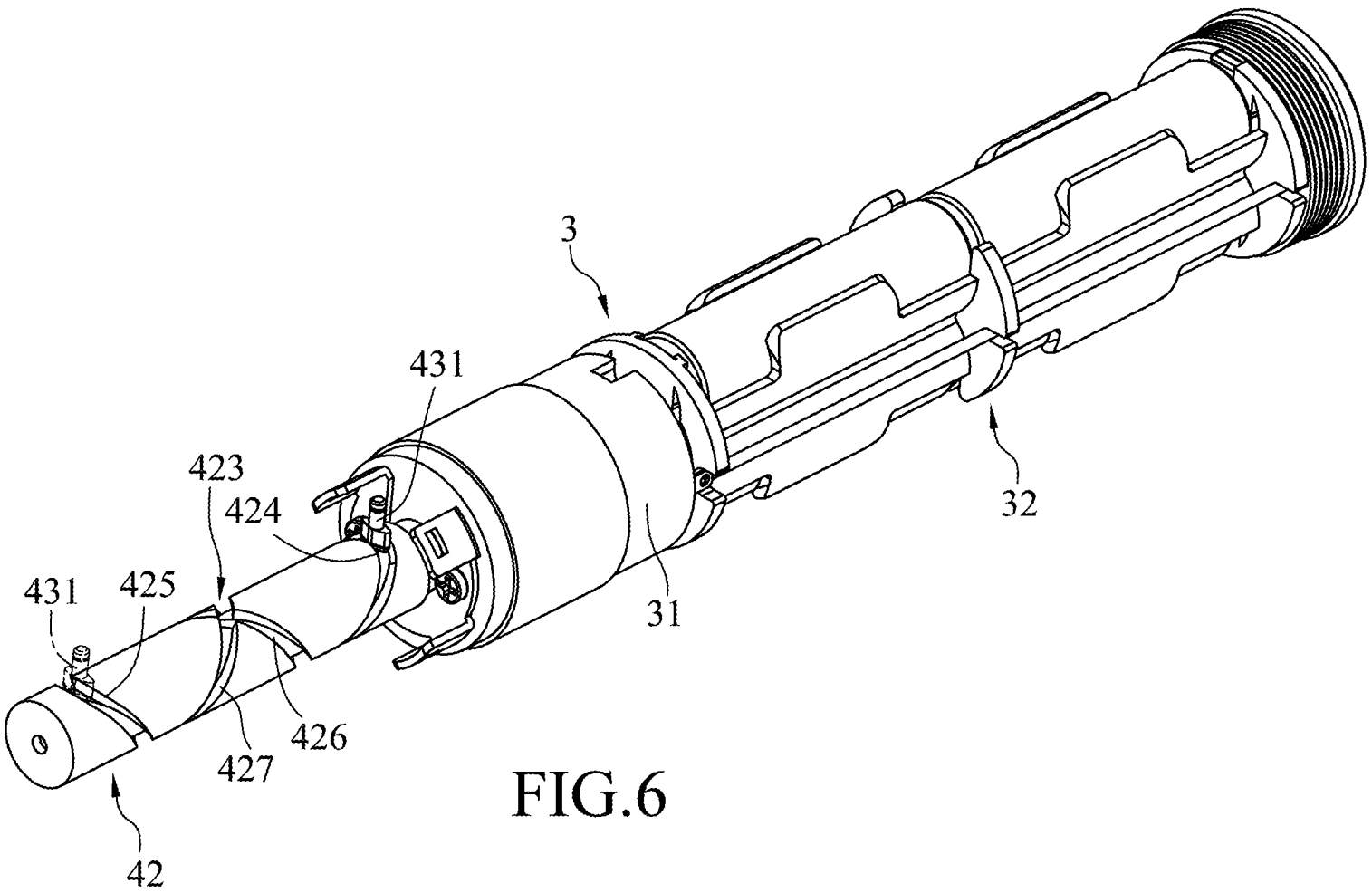
FIG. 6 is a perspective schematic view of the first embodiment, illustrating the linkage between a threaded driving rod, a guide pin, and the electric-driven mechanism.

Referring to FIGS. 1, 2 and 6, when the electric-driven air pump is at a default position as shown in FIG. 2, the movable valve seat 52 of the check valve 5 blocks the shrunk section 244 of the valve-controlled air passage 243 to close the shrunk section 244, and the guide pin 431 extends into the helical guide slot 423 in a position corresponding to the starting slot section 424 as shown in FIG. 6.

Figure 7:
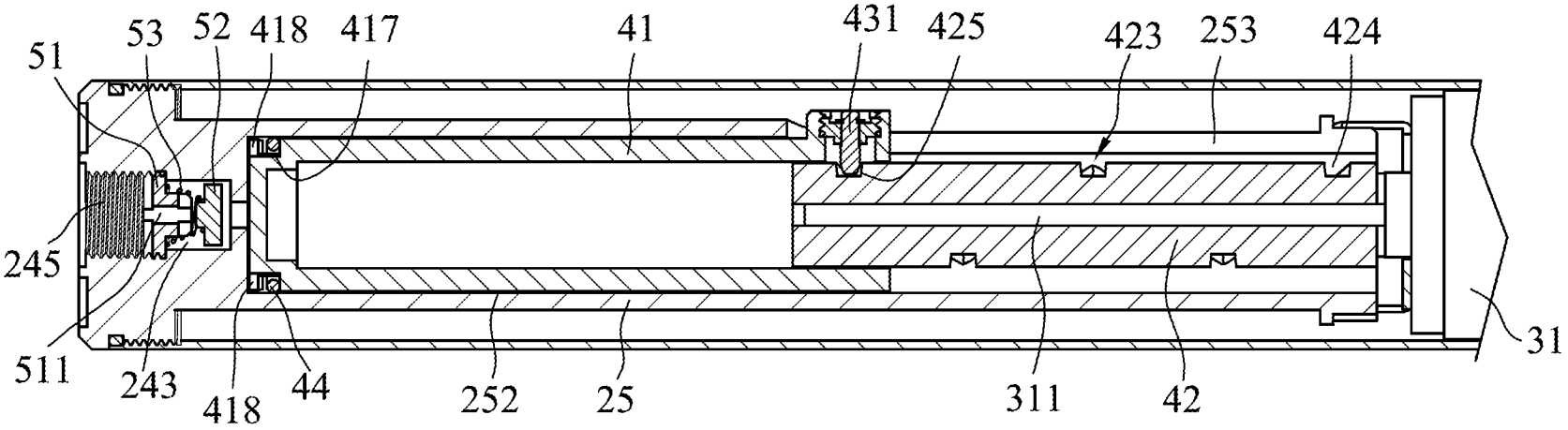
FIG. 7 is a fragmentary sectional view of the first embodiment, illustrating the driven piston in its pumping position.

Referring to FIGS. 2, 6 and 7, when the electric-driven air pump is switching from the default position (see FIG. 2) to a pumping position (see FIG. 7), after mounting the inflatable object at the expanded section 245 of the valve-controlled air passage 243, the shaft 311 of the motor 31 is activated by switching on the control switch 333 to rotate the threaded driving rod 42. The guide pin 431 would be driven to move along the helical guide slot 423 through the first guiding slot section 426 toward the ending slot section 425, simultaneously transferring the rotational power of the threaded driving rod 42 into axial movement of the driven piston 41. The electric-driven air pump is in the pumping position when the guide pin 431 reaches the ending slot section 425.

During the position switching, air stored within the cylinder chamber 252 would be pushed by the driven piston 41 to build up an air pressure large enough to overcome the biasing force of the resilient member 53 on the moving valve seat 52, such that the resilient member 53 is compressed to open the shrunk section 244 to allow for spatial communication between the outlet passage 511 of the fixed valve seat 51 and the cylinder chamber 252 of the cylinder 25, further allowing the inflatable object to be inflated.

Likewise, when the threaded driving rod 42 continuously rotates, the guide pin 431 moves along the second guiding slot section 427 from the ending slot section 425 to the starting slot section 424, simultaneously pulling the driven piston 41 toward the motor 31. At this time, outside air would be drawn into the cylinder chamber through the gap 418. When the guide pin 431 returns to the starting slot section 424, the electric-driven air pump returns to the default position. The reciprocal motion of the driven piston 41 would slowly drive the air into the inflatable object. In this embodiment, the threaded driving rod 42 rotated twice to switch between the positions.

Figure 8:
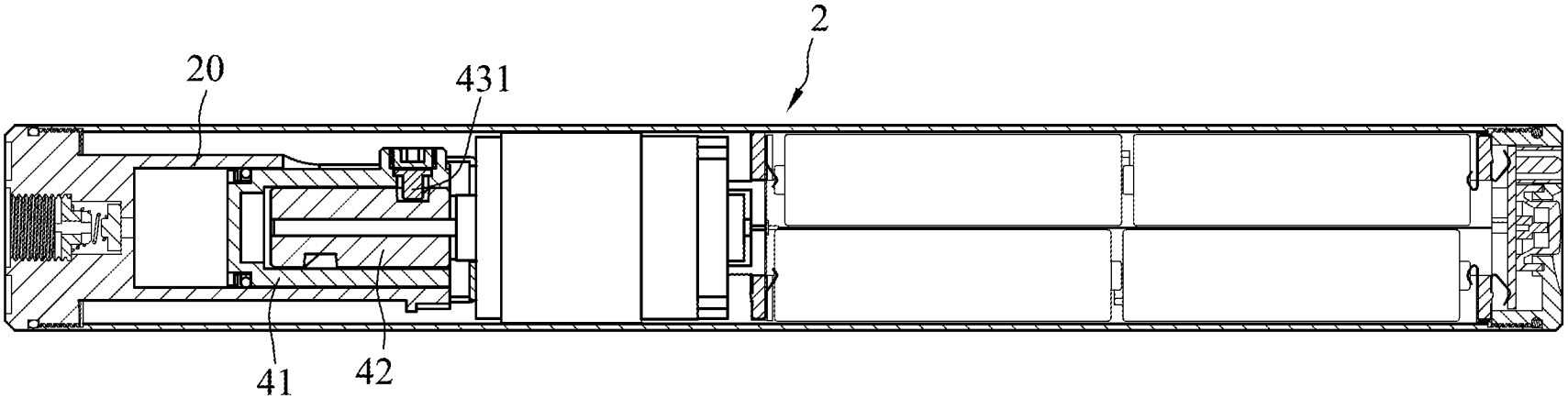
FIG. 8 is a fragmentary sectional view of a second embodiment of the electric-driven air pump, illustrating the driven piston in its default position.
Figure 9:
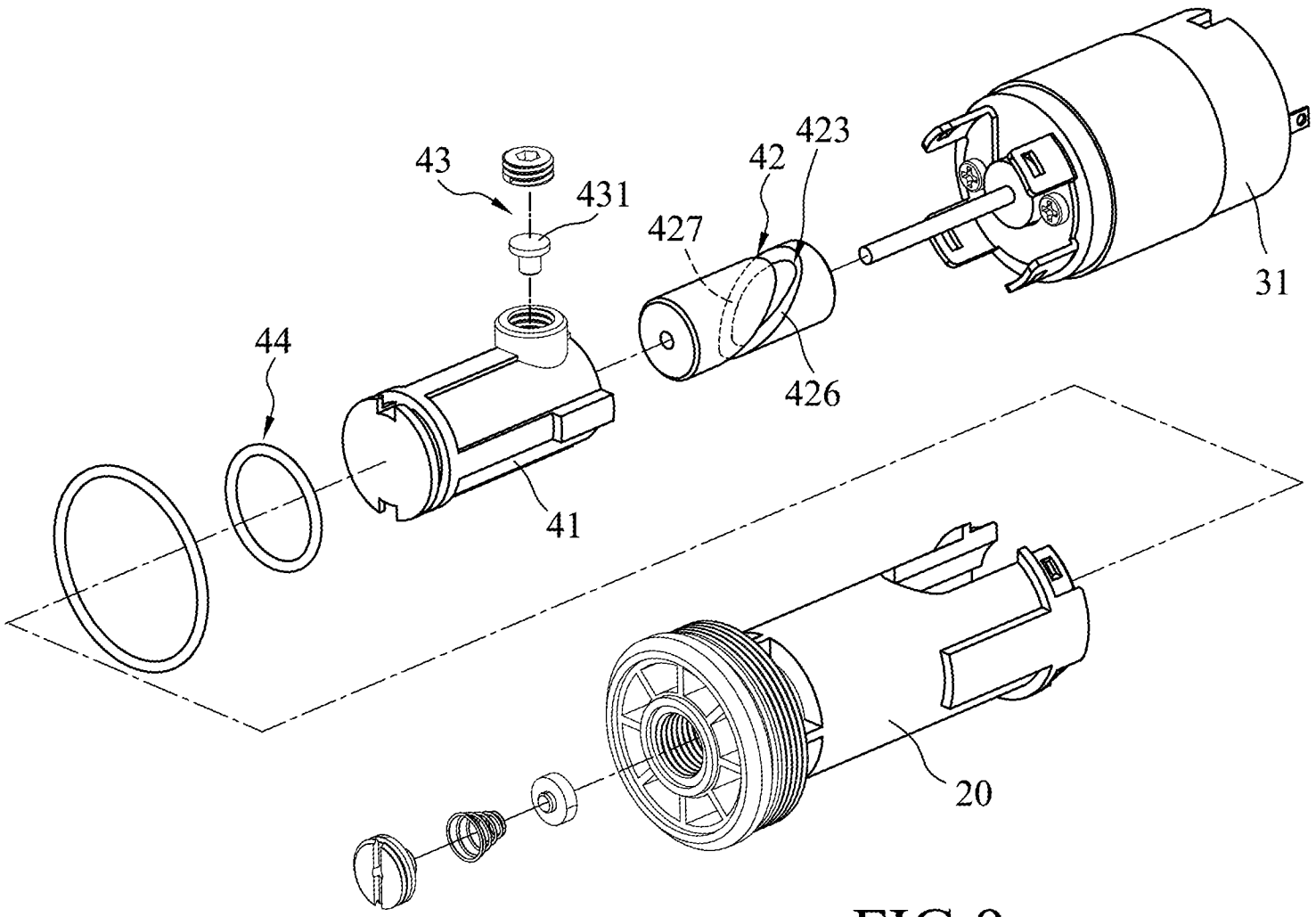
FIG. 9 is an exploded perspective view of the second embodiment.
Figure 10:
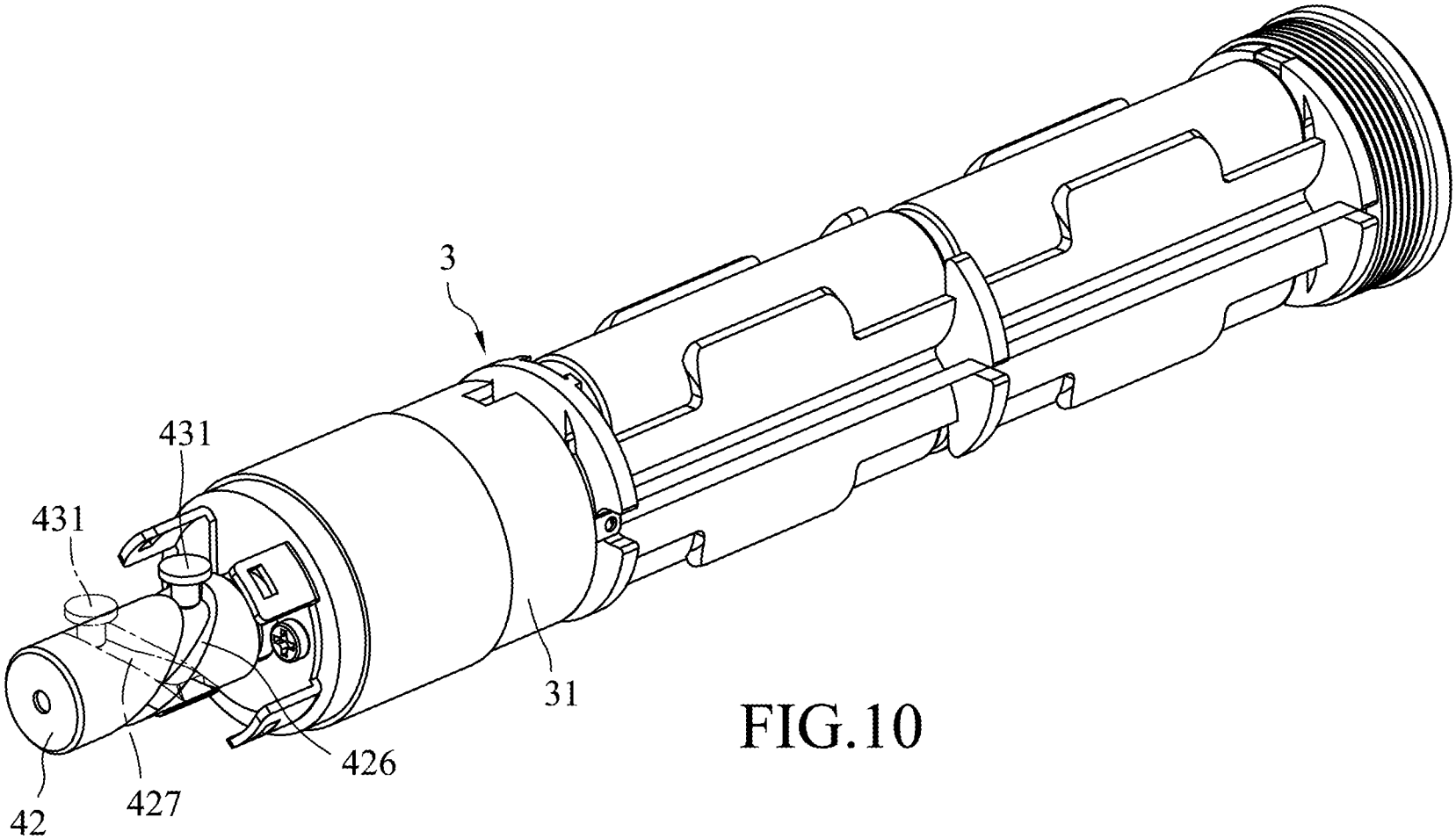
FIG. 10 is a perspective view of the second embodiment, illustrating the linkage between the threaded driving rod, the guide pin and the electric-driven mechanism.

Referring to FIGS. 8, 9 and 10, a second embodiment of the electric-driven air pump is similar to that of the first embodiment, notably having the first guiding slot section 426 and the second slot section 427 in the helical guide slot 423 of the threaded driving rod 42 as well. However, each of the first and second guiding slot sections 426, 427 has less than one helical turn, more specifically, half turn around the threaded driving rod 42 in this embodiment. With this in mind, whenever the threaded driving rod 42 make one turn, the driven piston 41 is able to switch back and forth from default position to pumping position once, while completing the task of pumping and intake of air. In general, comparing to the first embodiment, the second embodiment is able to pump air faster, but is unable to pump and intake as much air per each cycle.

Figure 11:
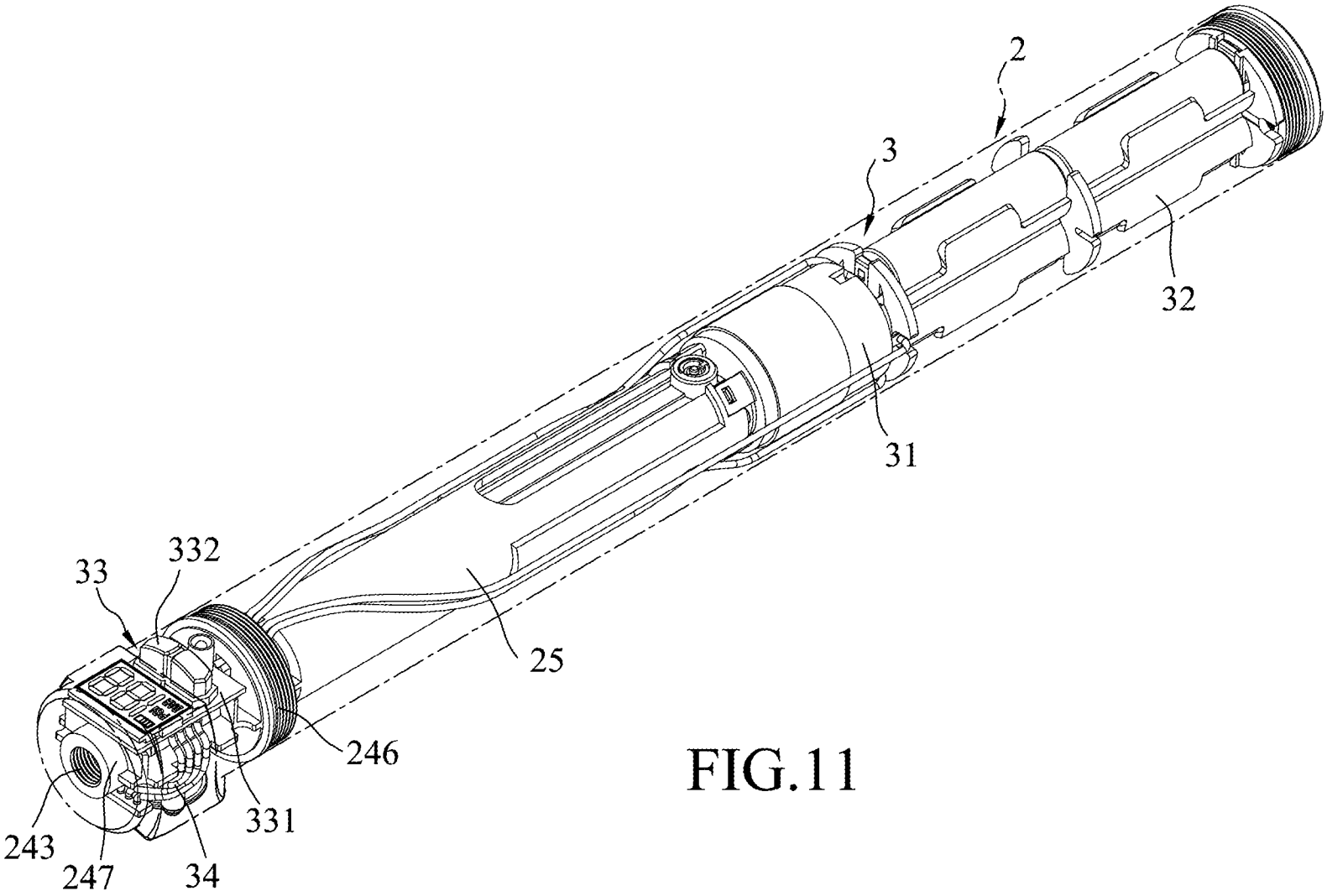
FIG. 11 is a schematic perspective view of a third embodiment of the electric-driven air pump.
Figure 12:
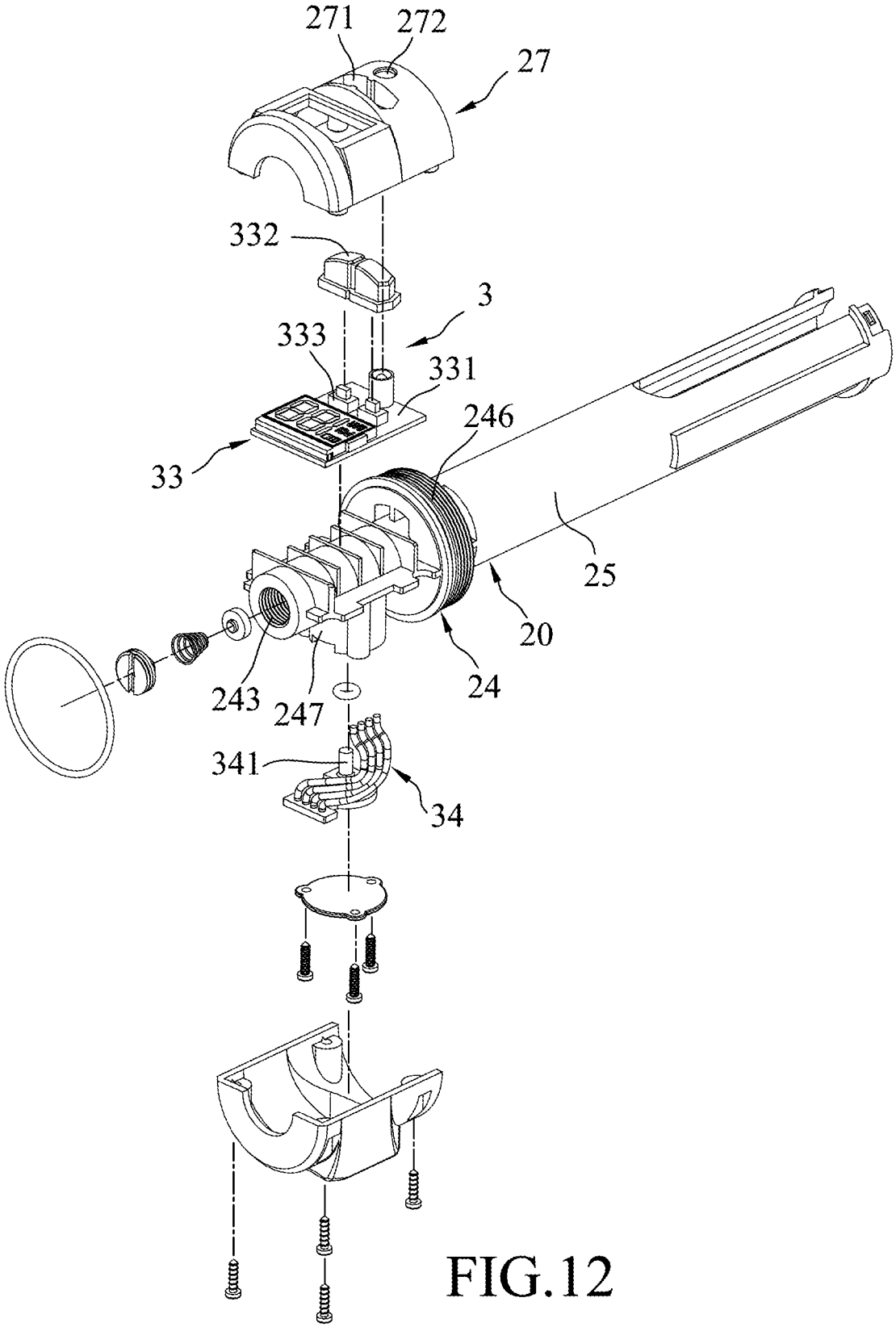
FIG. 12 is an exploded perspective view of the third embodiment.
Figure 13:
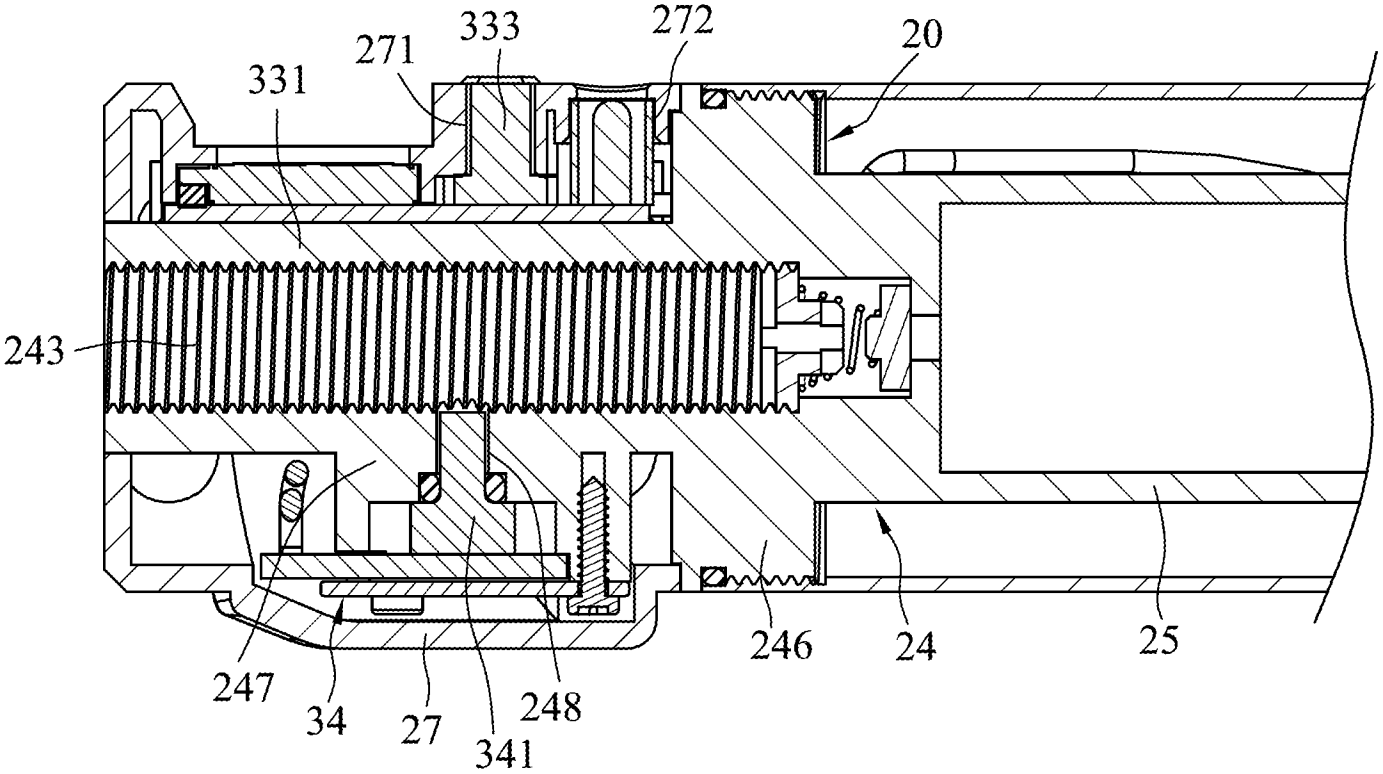
FIG. 13 is a fragmentary sectional view of the third embodiment.

Referring to FIGS. 11, 12 and 13, a third embodiment of the electric-driven air pump is similar to that of the first embodiment, with key differences in the electric driving mechanism. 3 and the outer housing unit 2. The connecting seat 20 includes the gas outlet section 24 and the cylinder 25, wherein the gas outlet section 24 further includes a connecting block 246 that is connected to the cylinder 25 and that is threadably engaged with the extending tube member 21, a protrusion block 247 that protrudes outwardly from the connecting block 246 and the extending tube member 21, and the valve-controlled air passage 243 that extends through the connecting block 246 and the protrusion block 247. The protrusion block 247 includes a sensor-receiving air passage 248 that is spatially communicated with the valve-controlled air passage 243. The outer housing unit 2 further includes a head cover 27 that covers the protrusion block 247 and that includes a second switch hole 271 and a second charge hole 272.

The electric driving mechanism 3, in addition to having the motor 31, the power supply module 32 and the controlling module 33, further includes a pressure sensor 34. The motor 31 and the power supply module 32 have same configuration as that in the first embodiment, while the controlling module 33 is covered by the head cover 27 and includes the circuit board 331, the control button 332 and the control switch 333. The circuit board 331 corresponds in position to the second switch hole 271 and includes a charge socket 334 that corresponds in position to the second charge hole 272. The pressure sensor 34 includes a pressure sensing member 341 that is disposed in the sensor-receiving air passage 248 and that is electrically connected to the circuit board 331.

In addition to having the same functionality as the first embodiment, the third embodiment bears an advantage in automatic sensing, in which the electric-driven air pump is able to cease the pumping function automatically through the circuit board 331. Whenever the pressure sensing member 341 detects specified amount of pressure within the valve-controlled air passage 243, the circuit board 331 would power off the motor 31 promptly, preventing unintentional buildup of the pressure that may cause harm to a user.

Overall, the embodiment utilized the guide pin 431 to transfer the rotational force from the threaded driving rod 42 into the reciprocal motion of the driven piston 41, removing the disadvantage associated with and the need for bevel gears.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that his disclosure is not limited to the disclosed embodiments but is intended to cover various arrangements included within the spirit and scope of the broadest interpretation so as to encompass all such modifications and equivalent arrangements.

What is claimed is:

1. An electric-driven air pump adapted to inflate an inflatable object, said electric-driven air pump comprising:

an outer housing unit including a connecting seat, said connecting seat including a gas outlet section adapted to be connected to the inflatable object, and a cylinder including a cylinder chamber, said gas outlet section including a valve-controlled air passage that is spatially communicated with said cylinder chamber;

an electric-driven mechanism mounted to said outer housing unit and including a motor; and a piston mechanism including:

a driven piston that is disposed in said cylinder chamber, a threaded driving rod rotated by said motor, connected to said driven piston in such a manner that rotation of said threaded driving rod drives reciprocal movement of said driven piston in said cylinder chamber, and formed with a helical guide slot, and a guide pin fixed in said driven piston and extending into said helical guide slot, wherein said motor is operable to rotate said threaded driving rod to drive reciprocal motion of said driven piston in said cylinder chamber, such that said guide pin moves along said helical guide slot;

wherein said cylinder further includes a cylinder wall that defines said cylinder chamber and that includes a longitudinal slot extending in a longitudinal direction, said driven piston including a surrounding wall, an end wall connected to an end of said surrounding wall, a receiving room defined by said surrounding wall and said end wall and receiving said threaded driving rod, a positioning protrusion protruding from said surrounding wall into said longitudinal slot, and an assembling hole extending through said positioning protrusion and said surrounding wall, said guide pin extending through said assembling hole; and wherein said helical guide slot includes a starting slot section, an ending slot section that is opposite to said starting slot section in the longitudinal direction, a first guiding slot section and a second guiding slot section, said first and second guiding slot sections being connected between said starting and ending slot sections, such that, when said guide pin moves from said starting slot section to said ending slot section along said first guiding slot section, the inflatable object is inflated, and when said guide pin moves from said ending slot section along said second guiding slot section, the inflatable object is not inflated.

2. The electric-driven air pump as claimed in claim 1, wherein each of said first and second guiding slot sections has at least two helical turns.

3. The electric-driven air pump as claimed in claim 1, wherein each of said first and second guiding slot sections has less than one helical turn.

4. The electric-driven air pump as claimed in claim 1, wherein said outer housing unit further includes an extending tube member that is registered with and connected to said connecting seat in the longitudinal direction, and a receiving space defined by said extending tube member and said connecting seat, said electric-driven mechanism further including a power supply module that is received in said receiving space and that is electrically connected to said motor to provide electric power to said motor, and a controlling module that is electrically connected to said motor and that is operable to control operation of said motor.

5. The electric-driven air pump as claimed in claim 4, wherein said outer housing unit further includes an end cover that is connected to an end of said extending tube member opposite to said connecting seat, said end cover including a first switch hole and a first charge hole, said power supply module including at least one battery, said controlling module including a circuit board that is electrically connected to said motor and said at least one battery, and a control switch that is electrically connected to said circuit board and that corresponds in position to said first switch hole, said circuit board including a charge socket that corresponds in position to said first charge hole.

6. The electric-driven air pump as claimed in claim 1, wherein said valve-controlled air passage including a shrunk section that is spatially communicated with said cylinder chamber, and an expanded section, said electric-driven air pump further comprising a check valve that is mounted in said expanded section, said check valve including a fixed valve seat that is fixedly connected to said connecting seat and that includes an outlet passage spatially communicated with said cylinder chamber, a movable valve seat that is disposed in said expanded section of said valve-controlled air passage, and a resilient member that is disposed between said fixed valve seat and said movable valve seat for biasing said moving valve seat to close said shrunk section so as to interrupt spatial communication between said outlet passage of said fixed valve seat and said cylinder chamber of said cylinder such that, when air pressure applied from said shrunk section is large enough to overcome the biasing force of said resilient member, said resilient member being compressed to open said shrunk section so as to allow for spatial communication between said outlet passage of said fixed valve seat and said cylinder chamber of said cylinder.

7. An electric-driven air pump adapted to inflate an inflatable object, said electric-driven air pump comprising:

an outer housing unit including a connecting seat, said connecting seat including a gas outlet section adapted to be connected to the inflatable object, and a cylinder including a cylinder chamber, said gas outlet section including a valve-controlled air passage that is spatially communicated with said cylinder chamber;

an electric-driven mechanism mounted to said outer housing unit and including a motor; and a piston mechanism including:

a driven piston that is disposed in said cylinder chamber, a threaded driving rod rotated by said motor, connected to said driven piston in such a manner that rotation of said threaded driving rod drives reciprocal movement of said driven piston in said cylinder chamber, and formed with a helical guide slot, and a guide pin fixed in said driven piston and extending into said helical guide slot, wherein said motor is operable to rotate said threaded driving rod to drive reciprocal motion of said driven piston in said cylinder chamber, such that said guide pin moves along said helical guide slot;

wherein said cylinder further includes a cylinder wall that defines said cylinder chamber and that includes a longitudinal slot extending in a longitudinal direction, said driven piston including a surrounding wall, an end wall connected to an end of said surrounding wall, a receiving room defined by said surrounding wall and said end wall and receiving said threaded driving rod, a positioning protrusion protruding from said surrounding wall into said longitudinal slot, and an assembling hole extending through said positioning protrusion and said surrounding wall, said guide pin extending through said assembling hole;

wherein said outer housing unit further includes an extending tube member that is registered with and connected to said connecting seat in the longitudinal direction, and a receiving space defined by said extending tube member and said connecting seat, said electric-driven mechanism further including a power supply module that is received in said receiving space and that is electrically connected to said motor to provide electric power to said motor, and a controlling module that is electrically connected to said motor and that is operable to control operation of said motor; and wherein said gas outlet section of said connecting seat further includes a connecting block that is connected to said extending tube member, and a protrusion block that protrudes from an end of said extending tube member, said valve-controlled air passage extending through said connecting block and said protrusion block, said outer housing unit further including a head cover that covers said protrusion block, and that includes a second switch hole and a second charge hole, said power supply module including at least one battery, said controlling module including a circuit board that is electrically connected to said motor and said at least one battery, and a control switch that is electrically connected to said circuit board and that corresponds in position to said second switch hole, said circuit board including a charge socket that corresponds in position to said second charge hole.

8. The electric-driven air pump as claimed in claim 7, wherein said gas outlet section further includes a sensor-receiving air passage that is spatially communicated with said valve-controlled air passage, said electric-driven mechanism further including a pressure sensor that includes a pressure sensing member disposed in said sensor-receiving air passage and being electrically connected to said circuit board.

9. The electric-driven air pump as claimed in claim 7, wherein said valve-controlled air passage including a shrunk section that is spatially communicated with said cylinder chamber, and an expanded section, said electric-driven air pump further comprising a check valve that is mounted in said expanded section, said check valve including a fixed valve seat that is fixedly connected to said connecting seat and that includes an outlet passage spatially communicated with said cylinder chamber, a movable valve seat that is disposed in said expanded section of said valve-controlled air passage, and a resilient member that is disposed between said fixed valve seat and said movable valve seat for biasing said moving valve seat to close said shrunk section so as to interrupt spatial communication between said outlet passage of said fixed valve seat and said cylinder chamber of said cylinder such that, when air pressure applied from said shrunk section is large enough to overcome the biasing force of said resilient member, said resilient member being compressed to open said shrunk section so as to allow for spatial communication between said outlet passage of said fixed valve seat and said cylinder chamber of said cylinder.

* * * * *